US010504320B2

(12) United States Patent
Jacques et al.

(10) Patent No.: US 10,504,320 B2
(45) Date of Patent: Dec. 10, 2019

(54) GAMING DEVICES WITH GRAPHENE INK-ENABLED FEATURES

(71) Applicant: Bally Gaming, Inc., Las Vegas, NV (US)

(72) Inventors: David Jacques, L'Ancienne Lorette (CA); Real Berube, St-Nicolas (CA)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/370,954

(22) Filed: Dec. 6, 2016

(65) Prior Publication Data

US 2017/0161985 A1 Jun. 8, 2017

Related U.S. Application Data

(63) Continuation of application No. PCT/IB2015/000927, filed on Jun. 12, 2015.

(60) Provisional application No. 62/011,722, filed on Jun. 13, 2014.

(51) Int. Cl.

| | |
|---|---|
| ***G07F 17/32*** | (2006.01) |
| ***A47B 25/00*** | (2006.01) |
| ***A47B 13/08*** | (2006.01) |

(52) U.S. Cl.

CPC ..... *G07F 17/322* (2013.01); *A47B 25/00* (2013.01); *G07F 17/3206* (2013.01); *G07F 17/3209* (2013.01); *G07F 17/3211* (2013.01); *A47B 13/08* (2013.01); *A47B 13/086* (2013.01); *G07F 17/3239* (2013.01); *G07F 17/3258* (2013.01)

(58) Field of Classification Search

CPC ..... G07F 17/322; G07F 17/3206; G07F 17/3209; A47B 25/00; A47B 13/086

See application file for complete search history.

(56) References Cited

U.S. PATENT DOCUMENTS

| | | | | |
|---|---|---|---|---|
| 9,165,721 | B2 * | 10/2015 | Lee | H01G 11/36 |
| 9,309,124 | B2 * | 4/2016 | Loh | B01J 21/185 |
| 9,743,171 | B1 * | 8/2017 | Anderson | H04R 1/1041 |
| 2003/0071415 | A1 * | 4/2003 | Huard | G07F 17/32 273/274 |
| 2007/0057469 | A1 * | 3/2007 | Grauzer | G07F 17/32 273/309 |

(Continued)

OTHER PUBLICATIONS

Condliffe, Jamie. "Graphene Ink Will Let Us Print Circuits on Pretty Much Anything." Nov. 5, 2013. Gizmodo. <http://gizmodo.com/graphene-ink-will-let-us-print-circuits-on-pretty-much-1458664003>.*

(Continued)

*Primary Examiner* — William H McCulloch, Jr.
(74) *Attorney, Agent, or Firm* — TraskBritt

(57) ABSTRACT

A gaming table includes graphene ink-enabled electronic features such as conductors, light or sound emitters, light detectors, touch or object detectors or displays. Conductive graphene ink may be printed on a gaming table fabric or felt which forms a playing surface of the gaming table. The graphene ink-enabled electronic features may be coupled to or controlled by one or more controllers and be integrated into associated gaming systems. The graphene ink-enabled features may replace large, expensive individual electronic components which must be assembled to implement functionality at a gaming table or other gaming device.

19 Claims, 1 Drawing Sheet

(56) References Cited

U.S. PATENT DOCUMENTS

| | | | | |
|---|---|---|---|---|
| 2012/0028127 | A1* | 2/2012 | Wei | B82Y 30/00 429/300 |
| 2012/0145234 | A1* | 6/2012 | Roy-Mayhew | H01G 9/2022 136/256 |
| 2012/0170171 | A1* | 7/2012 | Lee | H01G 11/36 361/502 |
| 2013/0102084 | A1* | 4/2013 | Loh | B01J 21/185 436/94 |
| 2013/0105189 | A1* | 5/2013 | Murthy | B25B 21/00 173/178 |
| 2013/0202766 | A1* | 8/2013 | Rubinsky | A23L 3/32 426/590 |
| 2014/0212760 | A1* | 7/2014 | Zhao | H01M 4/0419 429/231.8 |
| 2014/0300251 | A1* | 10/2014 | Colli | H01L 41/25 310/339 |
| 2015/0287904 | A1* | 10/2015 | White | H01L 41/113 310/319 |
| 2017/0161985 | A1* | 6/2017 | Jacques | G07F 17/322 |

OTHER PUBLICATIONS

International Search Report for International Application No. PCT/IB2015/000927, dated Oct. 9, 2015, 3 pages.
International Written Opinion for International Application No. PCT/IB2015/000927, dated Oct. 9, 2015, 3 pages.

* cited by examiner

GAMING DEVICES WITH GRAPHENE INK-ENABLED FEATURES

PRIOR APPLICATION DATA

This application is a continuation of, claims priority to and the benefit of PCT Application No. PCT/IB2015/000927, which was published as WO 2015/189686 on Dec. 17, 2015 and claims priority to and the benefit of U.S. Provisional Patent Application No. 62/011,722 filed Jun. 13, 2014.

FIELD OF THE INVENTION

The present invention relates to gaming devices such as gaming tables.

BACKGROUND OF THE INVENTION

Gaming tables are utilized to implement a variety of games, including wagering games. These games may include, but are not limited to poker, baccarat and other games.

Originally, gaming tables were purely mechanical. The tables included a playing surface upon which cards, chips or the like could be placed. Cards were dealt manually and chips wagered and collected manually.

Recently, electronic gaming tables have been developed. These gaming tables incorporate one or more electronic features. The electronic features might comprise, for example, LED or LCD displays, lights or other electrically powered elements. The displays, lights or other features are built into the structure of the gaming machine, so as to be supported and/or protected by the structure of the table. These tables, however, are very expensive to manufacture and operate owing to the complexity of integrating the different electronic components into the table.

SUMMARY OF THE INVENTION

Aspects of the invention comprise gaming devices and methods of creating/manufacturing gaming devices, and methods of using such devices.

In one embodiment, a gaming table includes graphene ink-enabled electronic features such as conductors, light or sound emitters, light detectors, touch or object detectors or displays. Conductive graphene ink may be printed on a gaming table fabric or felt, which forms a playing surface of the gaming table. The graphene ink-enabled electronic features may be coupled to or controlled by one or more controllers and be integrated into associated gaming systems. The graphene ink-enabled features may replace larger, more expensive individual electronic components that must be assembled to implement functionality at a gaming table or other gaming device.

Further objects, features, and advantages of the present invention over the prior art will become apparent from the detailed description of the drawings that follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention comprises gaming devices having graphene ink-enabled electronic features. In one embodiment, a gaming table includes a playing surface having electronic features, which are enabled via graphene ink.

Figure 1:
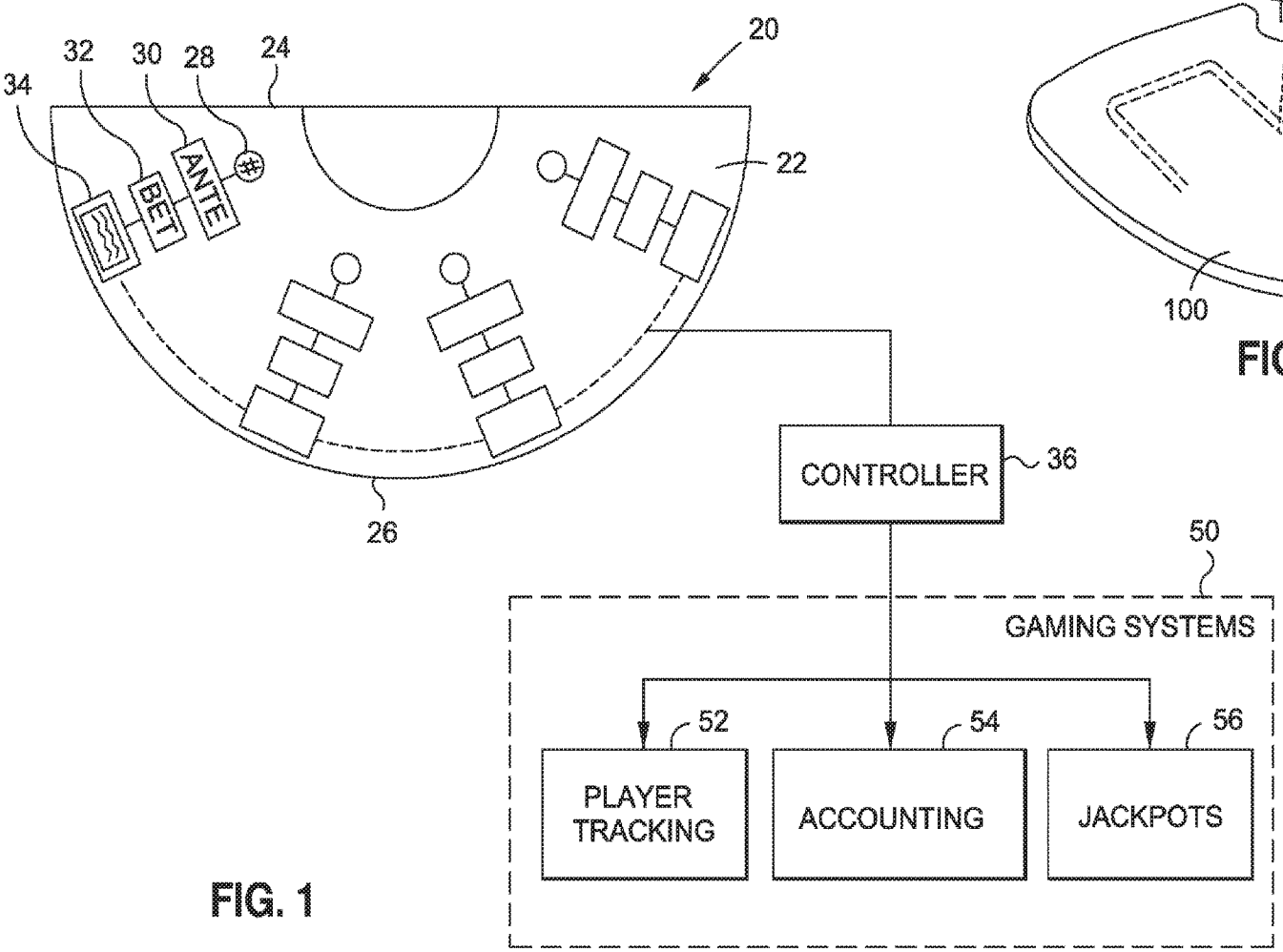
FIG. 1 illustrates a gaming system in accordance with an embodiment of the invention, the gaming system including at least one gaming table in accordance with the present invention.

One embodiment of the invention will be described with reference to FIG. 1. FIG. 1 illustrates one embodiment of a gaming device in accordance with an embodiment of the present invention. In this embodiment, the gaming device comprises a gaming table 20. The gaming table 20 may have a variety of configurations, including a variety of shapes, sizes and constructions. In one embodiment, the gaming table 20 defines at least one elevated playing surface 22. The playing surface 22 may be supported, for example, by a support structure, which includes one or more legs or other supports.

In one embodiment, the playing surface 22 is generally planar. However, the playing surface 22 could have raised and/or depressed areas. The playing surface 22 may be defined or covered by a fabric, such as felt or similar material.

The gaming table 20 may define or include one or more player areas and one or more dealer areas. For example, the gaming table 20 might have a first side 24 corresponding to a dealer area and a second side 26 corresponding to one or more player areas. Various information and/or features may be associated with the dealer and player areas.

In accordance with an embodiment of the invention, one or more of the features of the gaming table 20 are enabled or implemented by conductive ink or similar material, and most preferably conductive graphene ink. In a preferred embodiment, conductive graphene ink is used to create or define electrically conductive pathways or electronic components.

For example, graphene ink may be used to:

(1) define an electrically conductive pathway, such as to transmit electricity or electronic signals from one location to another, including between devices;
(2) detect light;
(3) emit light;
(4) emit sound;
(5) detect one or more objects;
(6) detect touch by a user;
(7) change the appearance of the playing surface (including via color, markings, 3-D texture, shape, etc.);
(8) be used as a display to display static or moving picture (video) information; and/or
(9) implement other features.

Figure 2:
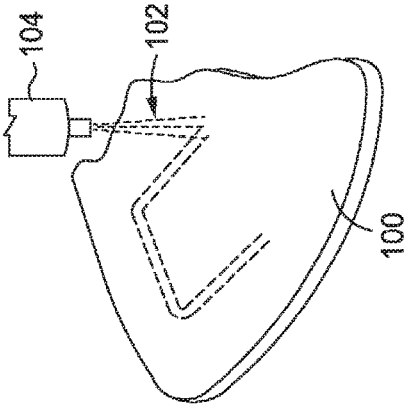
FIG. 2 illustrates the application of graphene ink via a printing device to a fabric or felt covering for a gaming table.

In one embodiment, graphene ink may be applied to or associated with the playing surface 22. For example, referring to FIG. 2, in one embodiment, graphene ink 102 may be applied to a felt 100 (or other fabric or material), which is associated with the gaming table 20 and forms the playing surface 22. As one example, the graphene ink 102 may be applied via a printer 104 or by other devices or methods, to the felt 100. In a preferred embodiment, the graphene ink is applied in a thin film or layer. The felt 100, or at least the graphene ink areas, may be covered (such as by a protective film) in order to protect them from damage and wear. Because these electronic features are created by printing or deposition, they are referred to herein as "printed" electronic features (of course, graphene ink may be applied in other manners, so the term "printed" electronic features is not intended to be limiting, but is only used for convenience). Of course, the ink (and thus the features created thereby) could be applied to other materials comprising the playing surface 22 (such as glass, polymer films, or other coating, which may be applied on or over a supporting substrate, such as a wood supporting surface, or even directly to the supporting substrate or surface itself).

The gaming table 20 may include various printed electronic features or components. For example, as illustrated in FIG. 1, graphene ink might be applied to the playing surface 22 to define a progressive wager area 28, an ante wager area 30, a bet wager area 32, and a game display 34 relative to each player location, among other features. In one embodiment, the graphene ink may be used to provide an illuminated border, which defines each of the progressive wager area 28, ante wager area 30 and bet wager area 32. The border might be illuminated in one or more colors (including white) and the color may change, such as depending upon whether a player has placed a wager relative to that area (which may be detected by touch input or object detection, including by a graphene ink-enabled detector relative to that area).

The game display 34 may comprise a graphene ink-enabled display, such as for displaying changeable game information such as information about the size of a wager, game status and/or a variety of other information (including game-related information and other information such as advertisements, etc.). This information might comprise alpha, numeric, icon, image and/or other visible information.

As indicated above, the graphene ink may be used to implement one or more features such as a light detector, light emitter, sound emitter, display, touch input detector, object detector or other devices.

In one embodiment, the gaming table's printed electronic features may be associated with one or more controllers 36. The controller 36 may be configured to receive input from the printed electronic features and/or to send information to those features. The controller 36 may comprise a computing-type device, which comprises at least one controller or processor, one or more data storage devices such as hard drives, flash drives, RAM, ROM, EPROM, or other types of data storage devices now known or later developed, and one or more communication interfaces. The controller 36 may be configured to execute various instructions either embodied as hardware or embodied as computer-readable code or "software" that is executed by a controller. The software may be stored on the associated memory or data storage devices, for example.

In one embodiment, the graphene ink-enabled or printed electronic features may be hard-wired to the controller 36. In other embodiments, the features might be configured as computing device peripherals, such as comprising USB type devices (in which event, the features might include a USB controller). In other embodiments, the features might include wired or wireless communication interfaces, such as to permit the features to communicate with the controller 36 (or other devices) via BLUETOOTH®, Wi-Fi, TCP-IP or other communication protocols.

In one embodiment, the gaming table 20 may be part of a larger gaming network 50. The gaming network 50 may include other features or components, such as other gaming tables, gaming machines such as video or slot machines, and one or more gaming systems, such as a player tracking system 52, an accounting system 54, and a jackpot systems 56, among others. The player tracking system 52, accounting system 54 and jackpot system 56 (and/or other systems) may be enabled by one or more computing devices, such as one or more servers. These systems may enable player tracking, accounting and jackpot functionality, as is well known in the casino arts. This connectivity allows integration of the printed electronic features with other gaming and non-gaming related devices and systems.

As one example, in the event a jackpot system 56 determines that a jackpot is active, the jackpot system 56 might send a jackpot instruction to the controller 36. The controller 36 might then cause graphene ink on the table surface 22, which is applied to spell the word "JACKPOT," to illuminate, thus providing an indication to players that this game feature is active. Likewise, bet information and other player inputs to graphene ink-enabled features may be transmitted to the controller 36 and thereon to the appropriate gaming systems, such as for tracking monies wagered and lost, game play parameters in association with identified players, etc.

Of course, the gaming table 20 illustrated in FIG. 1 is simply one embodiment of an implementation of the invention. For example, graphene ink might be used to implement other gaming device features. As indicated above, the graphene ink might be used to implement a variety of gaming-related functionality. This functionality might include, but is not limited to:

(1) Displaying game indicia, such as images of playing cards or the like, including based upon certain events or in mystery format;
(2) Highlighting a player's actions, such as placing of a bet or receiving other input, such as by changing a color or quantity of light emitted in one or more areas or via emitting sound;
(3) Detecting a player's presence at the gaming table;
(4) Highlighting the location or identify of a winner of a gaming event, such as the winner of a game or a jackpot;
(5) Changing a game table layout, such as to change the number of player locations (including adding or removing locations) or to configure the layout for use in presenting different types of games (such as different poker games, baccarat games or the like);
(6) Modify the appearance of the gaming table layout, such as based upon a random event;
(7) Make certain portions of the playing surface transparent or opaque;
(8) Cause sounds to be emitted from certain portions of the playing surface; and/or
(9) Receive player input, such as by detecting player touch of certain areas of the playing surface and/or detecting objects (such as chips, player tokens or the like).

In one embodiment, the gaming table 20 or other gaming device may have other electronic features (i.e., features that are not created via graphene ink). The one or more graphene ink implemented or "printed" features may be configured to integrate with or connect to those features. For example, graphene ink might be used to define a conductive pathway for electricity/power or electronic signals between the controller and an electronic device or two electronic devices.

This may avoid the need for standard wiring, including wiring harnesses, connectors and the like.

The printed electronic features might also integrate with other electronic devices. As but one example, a gaming table might include a card reader that is capable of obtaining an image of a physical playing card (or at least information that identifies the card, such as rank and suit information). The card information that is obtained by the card reader might be used to cause a printed display to display a graphical image of the one or more scanned cards. As one example, a card reader might read a bonus card, which is dealt from a deck of cards. An image of that card might be displayed on the printed displays 34 (see FIG. 1) at each player location. Of course, the printed electronic features of the invention might associate or integrate with a variety of other devices such as card shufflers, LED/LCD/plasma or other video displays, signs, lights, media readers (such as magnetic stripe, bar code, RFID or other readers), printers, etc.

It will also be appreciated that the invention may be applied to other gaming devices. For example, graphene ink might be applied to a surface of an electronic gaming machine in order to implement certain electronic features.

In the preferred embodiment of the invention, graphene ink is utilized to implement the electronic features because of its ease of application (such as via printing), low cost, flexibility (conforming to the substrate it is applied to and being flexible/bendable therewith), and its low profile/space requirements. Unlike wires, very thin layers of conductive graphene ink can be applied, which do not interfere with the feel of the gaming able. For example, unlike a wire placed on the surface of a gaming table, a layer of graphene ink does not create a ridge or bump on that surface. One advantage to the invention is that electronic features can be enabled simply by printing the conductive graphene ink on a table surface or a covering for that surface, rather than by associating individual electronic components with a table, connecting those components, etc. The entire configuration of a gaming table can be changed by either simply replacing the gaming table felt or by activating or deactivating certain ones of the graphene ink-enabled electronic feature. While conducive graphene ink is the preferred material that is used to implement the invention, other similar types of materials that are now known or later developed that have similar characteristics, could be utilized.

It will be appreciated that aspects of the invention comprise: (1) electronic features at a gaming device that are created by conductive ink; (2) the combination of such printed electronic features with other devices, (3) entire systems incorporating those printed electronic features, such as gaming systems, which include gaming devices (including tables) that include a printed electronic feature; and (4) methods of creating and using such features, devices and systems.

It will be understood that the above-described arrangements of apparatus and the method therefrom are merely illustrative of applications of the principles of this invention and many other embodiments and modifications may be made without departing from the spirit and scope of the invention as defined in the claims.

What is claimed is:

1. A method of creating a gaming table comprising the steps of:

providing a table having a support surface;

providing a support surface covering;

printing conductive graphene ink onto one or more areas of the support surface covering to create one or more electronic features, comprising:

defining wagering areas on the support surface indicating areas for receiving wagers from one or more users of the gaming table with the conductive graphene ink; and creating at least one lighting effect at a game display area on the support surface with the conductive graphene ink; and applying the support surface covering to the support surface of the table.

2. The method of claim 1, further comprising applying the graphene ink between a first location and a second location, wherein the one or more electronic features comprise a conductive path between the first location and the second location.

3. The method of claim 1, further comprising selecting the one or more electronic features to comprise at least one electronic component.

4. The method of claim 3, further comprising selecting the electronic component from the group consisting of: a light emitter, a light detector, a sound emitter, a touch detector and an object detector.

5. The method of claim 1, further comprising connecting the one or more electronic features to at least one controller.

6. The method of claim 1, further comprising selecting the support surface to comprise felt.

7. A gaming table comprising:

a support structure;

a table surface supported by the support structure;

a support surface covering located on at least a portion of the table surface; and conductive graphene ink defining at least one electronic feature applied to at least a portion of the support surface covering, the at least one electronic feature comprising at least one of wagering areas on the support surface covering indicating areas for receiving wagers from one or more users of the gaming table or at least one game display area on the support surface covering for displaying at least one lighting effect with the conductive graphene ink.

8. The gaming table of claim 7, wherein the support surface covering comprises felt.

9. The gaming table of claim 7, wherein the at least one electronic feature is selected from the group consisting of: a light emitter, a light detector, a sound emitter, a touch detector, and an object detector.

10. The gaming table of claim 7, further comprising at least one controller electrically coupled to the at least one electronic feature.

11. A method of providing a gaming surface for a wagering game, the method comprising:

defining at least one of wagering areas on the gaming surface for indicating areas for receiving wagers from one or more users of the gaming surface with conductive graphene ink on the gaming surface or at least one game display area on the gaming surface for displaying at least one lighting effect with the conductive graphene ink on the gaming surface; and electronically powering the at least one of the wagering areas or the at least one game display area on the gaming surface via the conductive graphene ink.

12. The method of claim 11, wherein at least one game display area is defined and further comprising displaying changeable game information on the at least one game display area.

13. The method of claim 12, wherein displaying the changeable game information on the at least one game display area comprises presenting at least one of information about the size of a wager, game status information, or an advertisement.

14. The method of claim 11, further comprising illuminating at least a portion of the at least one of the wagering areas or the at least one game display area in one or more colors.

15. The method of claim 14, further comprising changing a color of the at least a portion of the at least one of the wagering areas or the at least one game display area.

16. The method of claim 15, wherein changing the color comprises altering the color in response to at least one of a user placing a wager or the user interacting with the at least one of the wagering areas or the at least one game display area.

17. The method of claim 14, further comprising altering an amount of light emitted by the at least a portion of the at least one of the wagering areas or the at least one game display area.

18. The method of claim 17, wherein altering the amount of light emitted comprises changing the amount of light in response to at least one of a user placing a wager or the user interacting with the at least one of the wagering areas or the at least one game display area.

19. The method of claim 11, further comprising selecting the gaming surface to comprise a table surface of a gaming table.

* * * * *